US006935015B2

(12) United States Patent
Fujimoto et al.

(10) Patent No.: US 6,935,015 B2
(45) Date of Patent: Aug. 30, 2005

(54) METHOD OF PRODUCING THERMISTOR CHIPS

(75) Inventors: Mitsuaki Fujimoto, Shiga (JP); Noboru Furukawa, Shiga (JP); Masahiko Kawase, Shiga (JP); Norimitsu Kito, Shiga (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 81 days.

(21) Appl. No.: 10/354,253

(22) Filed: Jan. 28, 2003

(65) Prior Publication Data

US 2003/0112116 A1 Jun. 19, 2003

Related U.S. Application Data

(62) Division of application No. 09/487,158, filed on Jan. 19, 2000, now abandoned.

(30) Foreign Application Priority Data

Feb. 15, 1999 (JP) ..... 11-036269

(51) Int. Cl.[7] ..... H01C 7/02; H01C 7/04

(52) U.S. Cl. ..... 29/612; 29/610.1; 29/611; 29/620; 257/777; 336/200; 338/21; 427/126.3

(58) Field of Search ..... 29/612, 610.1, 29/611, 620; 257/777; 336/200; 338/21; 427/126.3

(56) References Cited

U.S. PATENT DOCUMENTS

| | | | | |
|---|---|---|---|---|
| 1,784,435 A | * | 12/1930 | Grondahl | 29/612 |
| 2,609,644 A | | 9/1952 | Brown, Jr. et al. | 338/195 |
| 3,351,882 A | | 11/1967 | Kohler et al. | 338/22 R |
| 4,317,027 A | | 2/1982 | Middleman et al. | 338/22 R |
| 4,319,215 A | * | 3/1982 | Yamazaki et al. | 338/21 |
| 4,549,161 A | | 10/1985 | McTavish et al. | 338/22 R |
| 4,857,880 A | | 8/1989 | Au et al. | 338/22 R |
| 4,924,074 A | | 5/1990 | Fang et al. | 219/548 |
| 5,303,115 A | | 4/1994 | Nayar et al. | 361/106 |
| 5,864,281 A | | 1/1999 | Zhang et al. | 338/22 R |
| 5,939,972 A | | 8/1999 | Nagao et al. | 338/22 R |
| 5,952,911 A | | 9/1999 | Kawase et al. | 338/22 R |
| 6,157,289 A | | 12/2000 | Kojima et al. | 338/22 R |
| 6,172,592 B1 | * | 1/2001 | Inoue et al. | 338/22 R |

FOREIGN PATENT DOCUMENTS

| | | |
|---|---|---|
| JP | 02-178910 | 7/1990 |
| JP | 05-283206 | 10/1993 |
| JP | 09-17607 | 1/1997 |
| JP | 10-116706 | 5/1998 |

* cited by examiner

*Primary Examiner*—Carl J. Arbes
*Assistant Examiner*—Tim Phan
(74) *Attorney, Agent, or Firm*—Beyer Weaver & Thomas LLP

(57) ABSTRACT

Thermistor chips are produced by preparing thermistor bodies each having outer electrodes formed on its end parts and dipping them in a solvent so as to melt away exposed surface portions of the thermistor body. In order to efficiently adjust their resistance values so as to produce thermistor chips with resistance values having only small variations from a target value, the resistance value between the outer electrodes are measured for each and they are divided into ranks according to the measured resistance values, and the dipping process is carried out differently for different ranks such that different amounts of the thermistor body material will be melted away.

6 Claims, 8 Drawing Sheets

METHOD OF PRODUCING THERMISTOR CHIPS

This is a divisional of application Ser. No. 09/487,158 filed Jan. 19, 2000, now abandoned.

BACKGROUND OF THE INVENTION

This invention relates to methods of producing thermistor chips which may find use in temperature compensating circuits and temperature detecting elements.

FIG. 8 shows an example of a prior art thermistor chip 41 of this type disclosed in Japanese Patent Publication Tokkai 7-74006, characterized as comprising a thermistor body 42, outer electrodes 43, inner electrodes 44 and a surface electrode 45. The thermistor body 42 comprises a semiconducting ceramic material having oxides of Mn, Ni and Co as its main component. The outer electrodes 43 are formed on mutually opposite end parts of the thermistor body 42. The inner electrodes 44 are formed inside the thermistor body 44 and each electrically connected to a corresponding one of the outer electrodes 43. The surface electrode 45 is formed on one of the surfaces of the thermistor body 42 and is separated from the outer electrodes 43.

The resistance value of the thermistor chip 41 is adjusted by trimming the surface electrode 45, say, by exposing the surface electrode 45 to a laser beam to form a groove 45*c* and thereby obtaining trimming electrodes 45*a* and 45*b*. A thermistor chip of a desired resistance value is thus obtained.

If prior art technology is used for this process, however, the thermistor chip is heated up by the energy of the laser and the thermistor body generates small cracks, causing variations in the resistance values of thermistor chips after the trimming process. Another problem with this prior art technology is that a laser beam must be made incident individually on each of many thermistor chips to be produced for trimming. This means that the process is cumbersome to carry out and contributes to an increase in the production cost.

SUMMARY OF THE INVENTION

It is therefore an object of this invention in view of the problems of prior art technology outlined above to provide a method of producing thermistor chips by a simplified process of dipping a thermistor body in a solvent in order to partially melt away its externally exposed surfaces and to thereby increase the resistance between the outer electrodes such that thermistor chips can be produced with resistance values which are within a reduced range around a specified target value.

A thermistor chip embodying this invention, with which the above and other objects can be accomplished, may be characterized not only as comprising a thermistor body and outer electrodes which are formed on its mutually opposite end parts but also wherein the exposed portions of the surface of this thermistor body is indented without having any throughholes made and partially melted away by a solvent. The thermistor chip may be of a type having also surface electrodes which face opposite each other on one of main surfaces of the thermistor body, each of the outer electrodes being electrically connected to a corresponding one of the surface electrodes, as well as insulating layers which cover at least the surface electrodes and may also cover the other main surface.

Such thermistor chips may be produced first by preparing pre-processed thermistor chips each comprising a thermistor body having outer electrodes formed on its end parts and dipping these pre-processed thermistor chips in a solvent so as to melt away exposed surface portions of the thermistor body.

In order to efficiently produce thermistor chips with resistance values which are all within a reduced range, the thermistor chips prior to the processing of dipping in a solvent may be divided into ranks according to their resistance values and the dipping process is carried out differently for thermistor chips belonging to different ranks such that different amounts of the thermistor body material are melted away from thermistor chips belonging to different ranks.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1A:
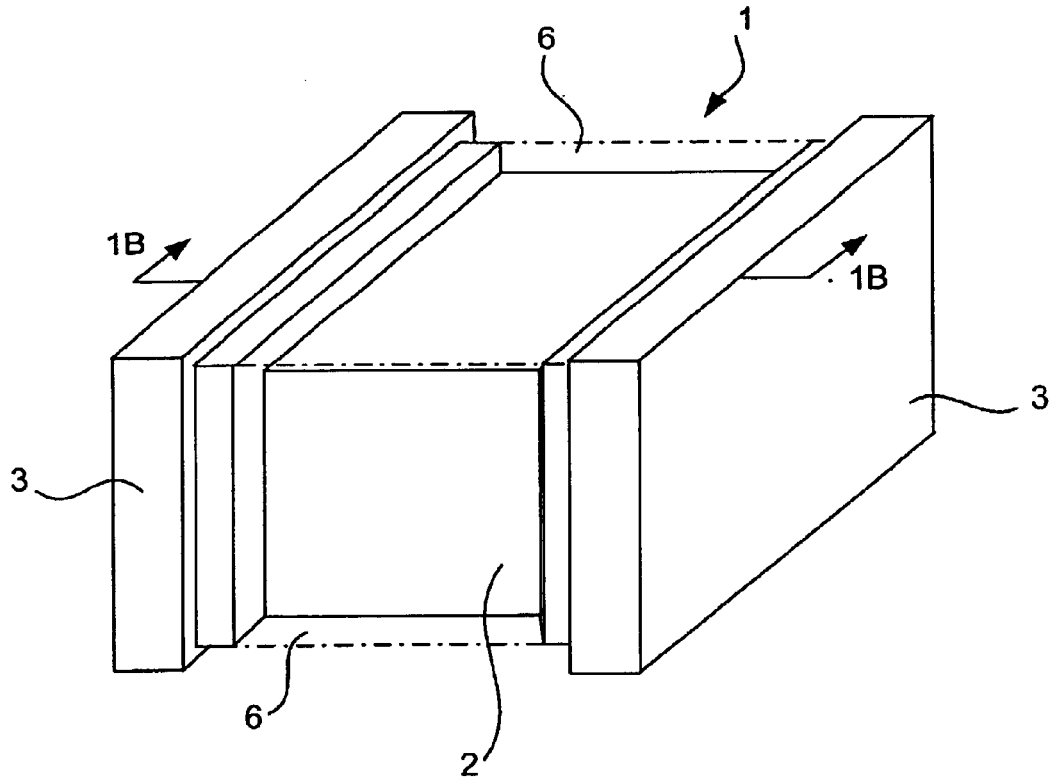
FIGS. 1A and 1B, together referred to as FIG. 1, show a thermistor chip according to one embodiment of this invention, FIG. 1A showing its external view and FIG. 1B being a sectional view taken along line 1B—1B of FIG. 1A.
Figure 1B:
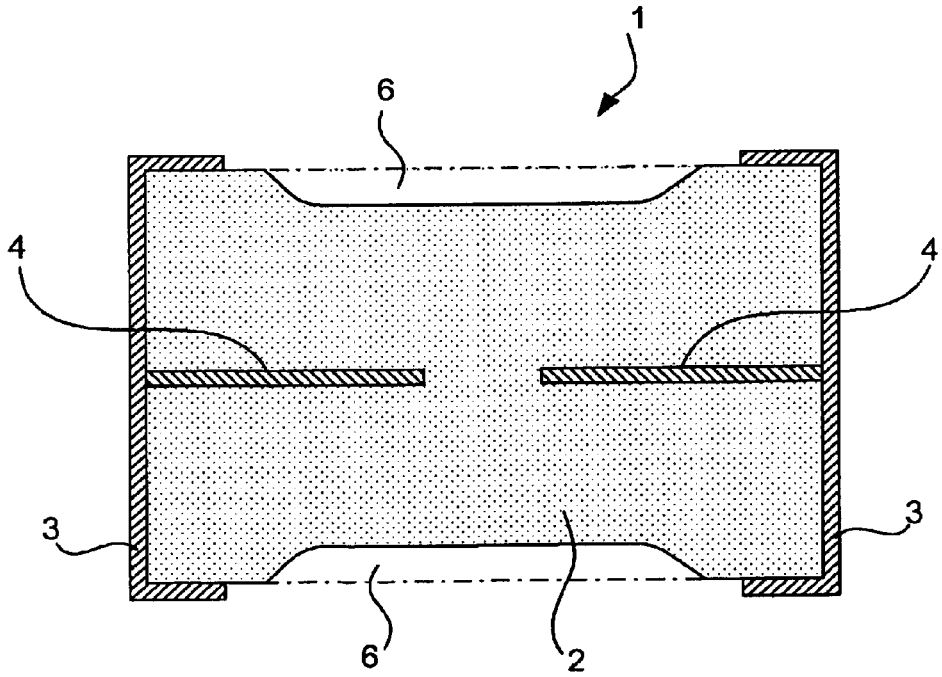

The invention is described next by way of an example. FIGS. 1A and 1B show a thermistor chip 1 embodying this invention, comprising a thermistor body 2, outer electrodes 3 and inner electrodes 4 and being characterized wherein that the thermistor body 2 has portions which have been melted away and indented (referred to as the "melted portions 6"). The thermistor body 2 comprises a semiconducting ceramic material having oxides of a plurality of transition metals such as Mn, Ni, Co, Fe, Cu and Al. Portions of the thermistor body surface except where the outer electrodes 3 are formed on mutually opposite end parts of the thermistor body 2 are melted away by a solvent 10 (shown in FIG. 3A and to be explained below) to form the indented melted portions 6. The inner electrodes 4 are formed inside the thermistor body 2 such that their inner end parts are opposite to each other while the outer end part of each is electrically connected to a corresponding one of the outer electrodes 3.

Figure 2A:
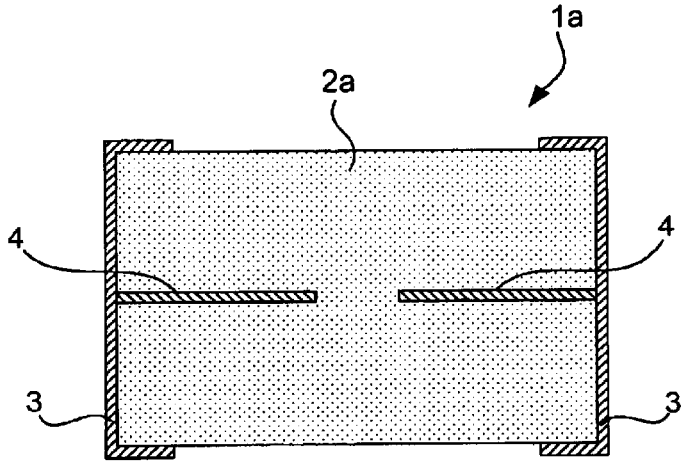
FIGS. 2A, 2B and 2C, together referred to as FIG. 2, show the steps in a method of production embodying this invention related to the forming of the resist layers on the thermistor chip of FIGS. 1A and 1B.
Figure 2B:
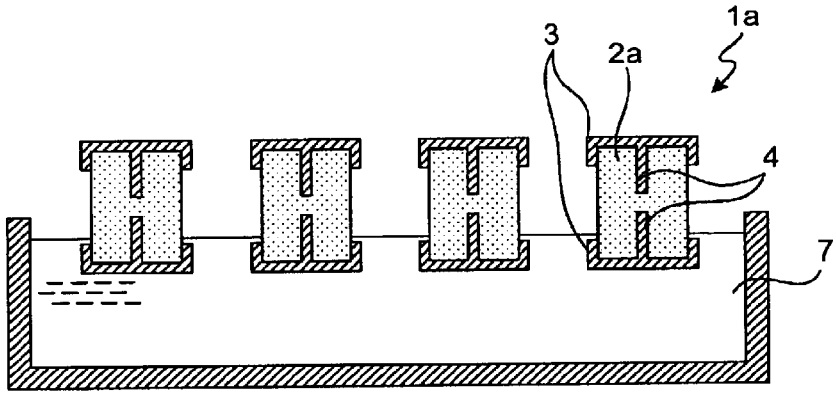
Figure 2C:
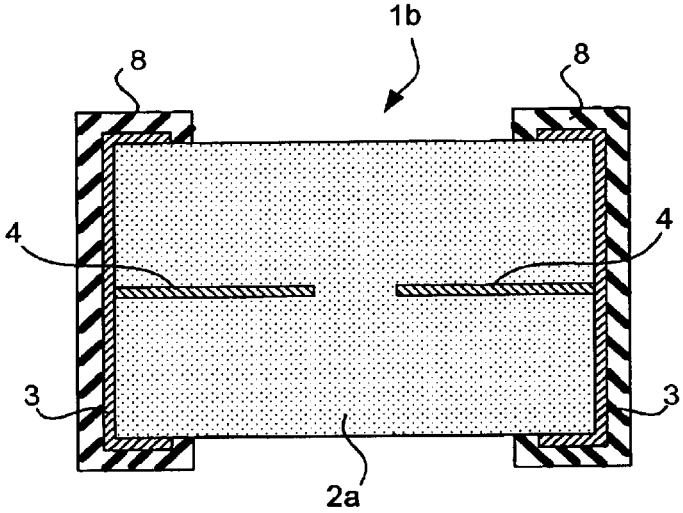

A method of producing this thermistor chip 1 is described next with reference to FIGS. 2 and 3. Firstly, a thermistor body 2*a* in the shape of a chip with inner electrodes 4 as shown in FIG. 2A is prepared. Outer electrodes 3 are then formed by applying an electrically conductive paste on its mutually oppositely facing end parts and baking it to obtain a thermistor chip 1*a* before the melting process, to be described below. Next, each outer electrode 3 on a corresponding end part of the thermistor chip 1*a* is dipped in a resist material 7 as shown in FIG. 1B, and the dipped thermistor chip 1*a* is thereafter dried for 20 minutes at 80° C. to obtain a thermistor chip 1*b* as shown in FIG. 2C with each outer electrode 3 covered by a resist layer 8. Photosensitive resins which are not melted by the solvent 10 (briefly referenced above and to be explained below) such as photoresists of cyclized rubber may be appropriately used as the resist 7.

Figure 3A:
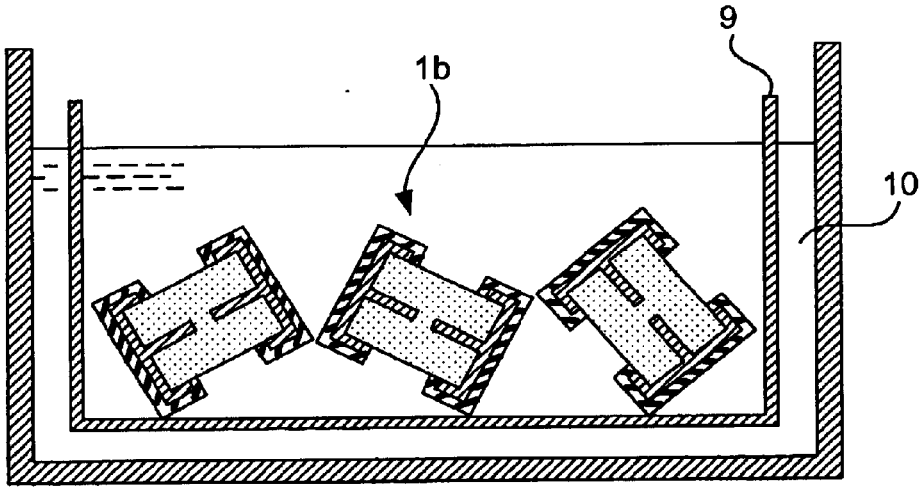
FIGS. 3A and 3B, together referred to as FIG. 3, show the steps in the method of production embodying this invention related to the melting of the thermistor body shown in FIGS. 1A and 1B.
Figure 3B:
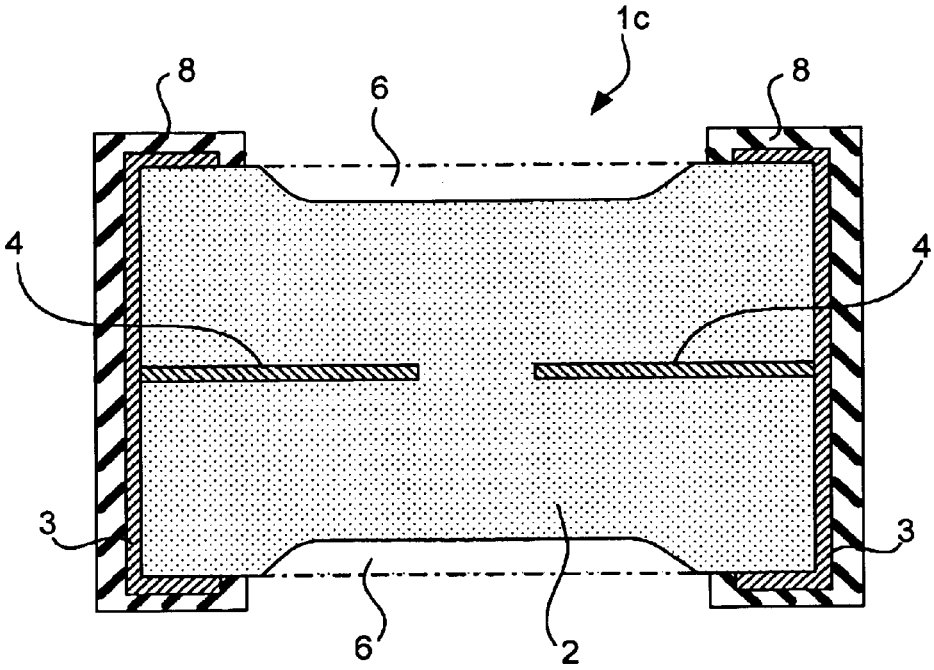

Next, thermistor chips 1*b* thus covered with resist layers 8 are placed inside a basket 9 and dipped in the aforementioned solvent 10, as shown in FIG. 3A, and the solvent 10 is stirred appropriately. An acid such as nitric acid, sulfuric acid or a phosphoric acid or a plating liquid, which can dissolve every element of the thermistor body 2 to thereby remove externally exposed surface portions thereof, may be used as the solvent 10. As a result of this melting process, a thermistor chip 1*c* as shown in FIG. 3B is obtained with exposed surfaces of its thermistor body 2 (not covered by the resist layers 8) partially melted away to form the indented melted portions 6. After this melting process, the resist layers 8 of the thermistor chip 1*c* are removed by using a resist-removing liquid (not shown) to obtain a finished thermistor chip 1 shown in FIG. 1. A liquid which can dissolve only some of the constituent elements of the thermistor body 2 may be used as the solvent 10. If a thermistor body 2 having Mn and Ni as its main components is dipped in a solution of ferric chloride which dissolves Ni but not Mn, only the Ni portion of the thermistor body 2 is dissolved, and the resistance of the melted portion changes, thereby affecting the resistance value of the thermistor body 2 as a whole. Although some specific examples of solvent 10 were mentioned above, the kind of solvent to be used is not intended to limit the scope of the invention. Any agent capable of melting the thermistor body 2 may be used, and the material for the resist 7 may be thereafter selected among those which are not melted by the solvent 10 of the selected kind.

Figure 4A:
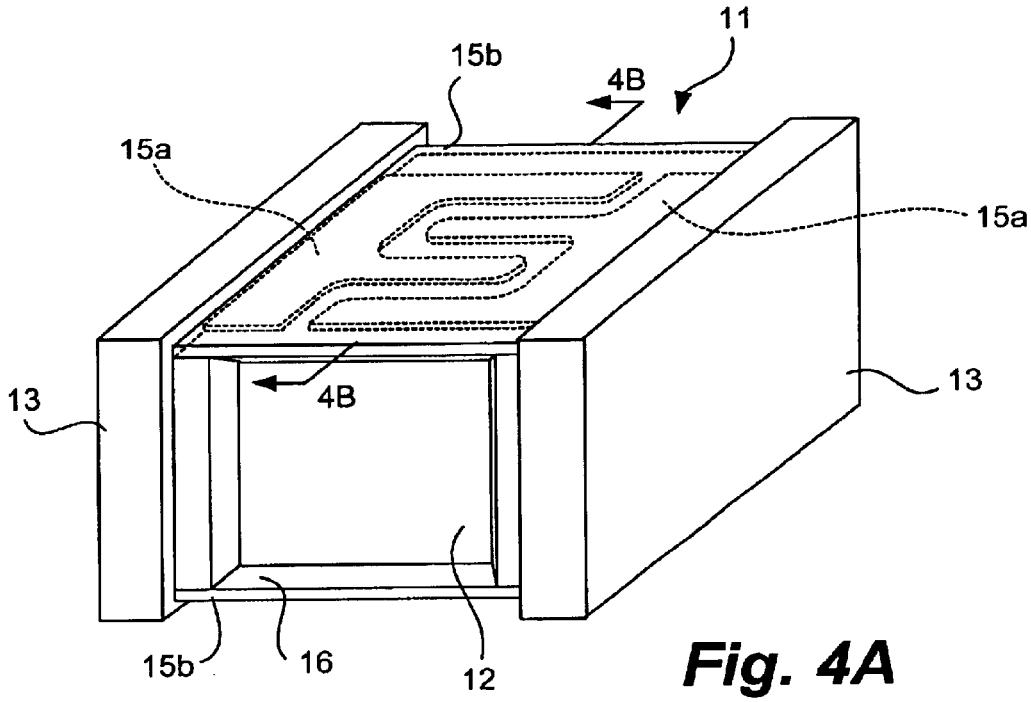
FIGS. 4A and 4B, together referred to as FIG. 4, show a thermistor chip according to another embodiment of this invention, FIG. 4A showing its external view and FIG. 4B being a sectional view taken along line 4B—4B of FIG. 4A.
Figure 4B:
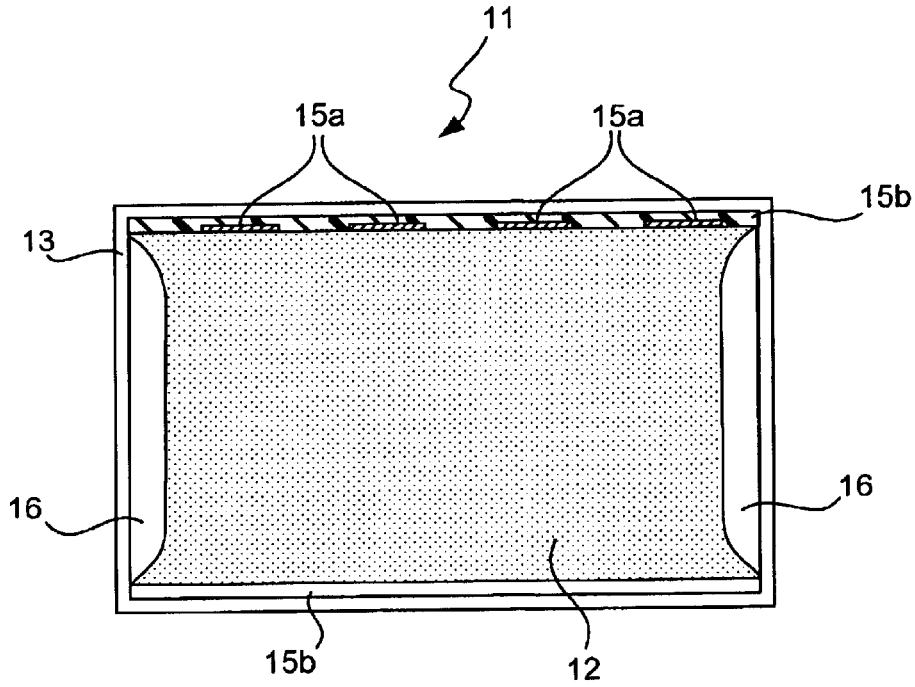

FIGS. 4A and 4B show another thermistor chip 11 embodying this invention, comprising a thermistor body 12, outer electrodes 13, surface electrodes 15*a* and insulating layers 15*b*, the thermistor body 12 having melted portions 16 formed thereon. The thermistor body 12 comprises a semiconducting ceramic material having oxides of a plurality of transition metals such as Mn, Ni, Co, Fe, Cu and Al. The melted portions 16 are formed on portions of the side surfaces of the thermistor body 12 not covered by the outer electrodes 13 formed on mutually opposite end parts or the insulating layers 15*b* on both main surfaces of the thermistor body 12. The surface electrodes 15*a* are formed on one of the main surfaces of the thermistor body 12 as a pair of interdigitally arranged comb-shaped electrodes each having a plurality of fingers. Each of the pair of surface electrodes 15*a* is electrically connected to a corresponding one of the outer electrodes 13 at the corresponding end part of the thermistor body 12. One of the insulating layers 15*b* is formed so as to cover the surface electrodes 15*a* on one of the main surfaces of the thermistor body 12, the other of the insulating layers 15*b* covering the other main surface of the thermistor body 12. The invention does not impose any particular limitation on the material to be used for forming the insulating layers 15*b* but heat-resistant resins such as polyimide with temperature of thermal deformation over 150° C. (measured according to ASTM-D648) which will not dissolve in the solvent 10 are preferred.

To produce a thermistor chip as shown at 11 in FIG. 4, a thermistor body 12 in the shape of a hexadron is prepared, and the surface electrodes 15*a* are formed on one of its main surfaces, for example, by sputtering a suitable electrode material comprising Ag. The insulating layers 15*b* are formed by applying an insulating material over these surface electrodes 15*a* and the other main surface of the thermistor body 12. Next, an electrically conductive paste is applied to the two end parts of the thermistor body 12 and baked to form the outer electrodes 13 such that each of them will be electrically connected to a corresponding one of the surface electrodes 15*a* at the corresponding end part of the thermistor body 12. Thereafter, as explained by way of the embodiment of the invention shown in FIGS. 1–3, resist layers are formed on both end parts of the thermistor chip obtained as described above, and the thermistor chip is dipped in a solvent 10 to partially melt away the externally exposed portions on the side surfaces of the thermistor body 12, not covered with the resist layers or the insulating layer. The resist layers are finally removed by means of a resist-removing liquid to obtain the thermistor chip 11 as shown in FIG. 4.

As a variation, the insulating layer 15*b* may be formed only so as to cover the surface electrodes 15*a*, leaving the other main surface of the thermistor body 12 uncovered thereby. In such a case, the other main surface is also melted by the solvent 10 and an indented melted portion is additionally formed on this main surface.

Figure 5A:
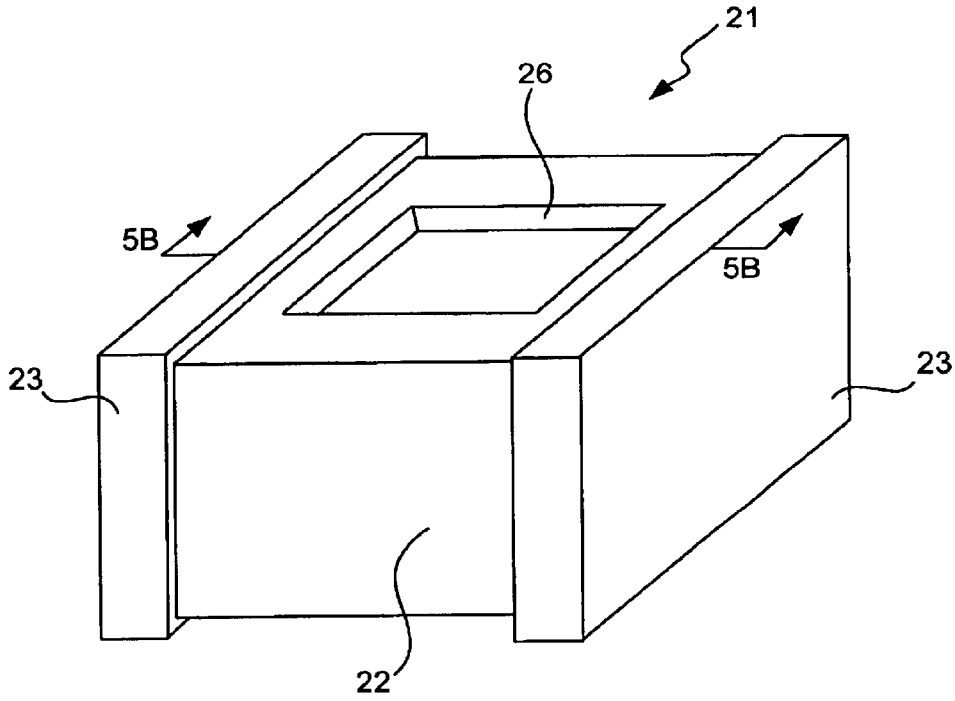
FIGS. 5A and 5B, together referred to as FIG. 5, show a thermistor chip according to still another embodiment of this invention, FIG. 5A showing its external view and FIG. 5B being a sectional view taken along line 5B—5B of FIG. 5A.
Figure 5B:
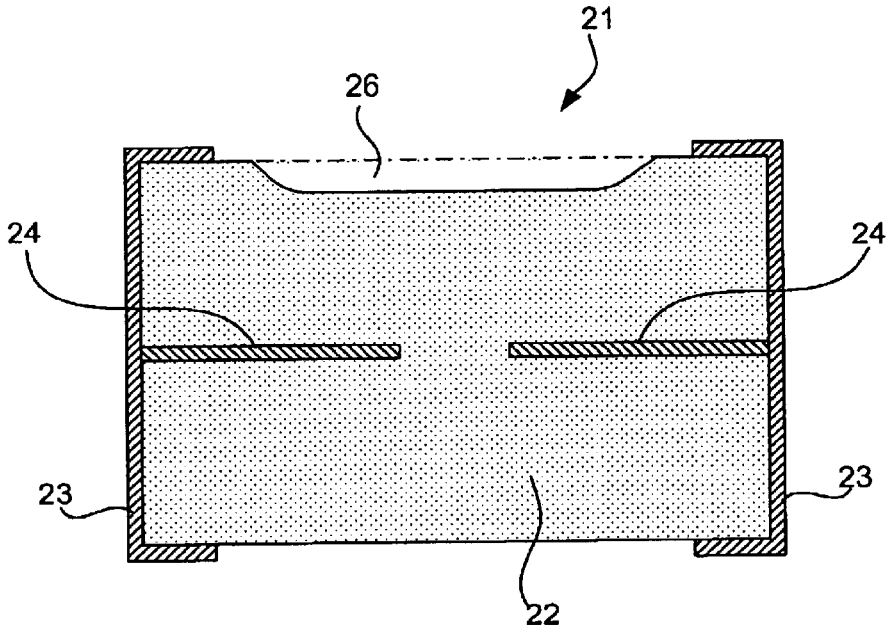

FIGS. 5A and 5B show still another thermistor chip 21 embodying this invention, comprising a thermistor body 22 having a pair of mutually oppositely facing planar parallel main surfaces, outer electrodes 23 and inner electrodes 24, the thermistor body 22 having an indented melted portion 26 formed thereon. The thermistor body 22 comprises a semiconducting ceramic material having oxides of a plurality of transition metals such as Mn, Ni, Co, Fe, Cu and Al. The melted portion 26 is formed on an externally exposed surface portion of the thermistor body 22 not covered by the outer electrodes 23, melted away by a solvent (as explained above with reference to FIG. 3A). Throughout herein, the melted portion such as indicated by numeral 26 will be referred to as an indentation within its narrow sense of the word excluding a throughhole. It is further to be noted that the melted portion 26 has a smoothly changing surface contour without any sharp edges or corners because it is formed by melting, not by cutting with a machine or the like. The inner electrodes 24 are formed as a mutually oppositely disposed pair inside the thermistor body 22, each in an electrically connected relationship with a corresponding one of the outer electrodes 23.

To produce a thermistor chip as shown at 21 in FIG. 5, a thermistor body 22 is prepared first and outer electrodes 23 are formed on its mutually opposite end parts. Next, a resist layer (not shown) is formed all over the thermistor body 22 and the outer electrodes 23 except over a specified area where the melted portion 26 is intended to result. The thermistor body 22 is thereafter dipped in a solvent 10 as described above to cause the thermistor body 22 to be melted away over the specified area. Thereafter, the resist layer is removed by means of a resist-removing liquid to obtain the thermistor chip 21 as shown in FIG. 5. By this method, the melted portion 26 can be formed anywhere on the surface of the thermistor body 22 by appropriately selecting the areas over which the resist layer is formed.

Figure 6A:
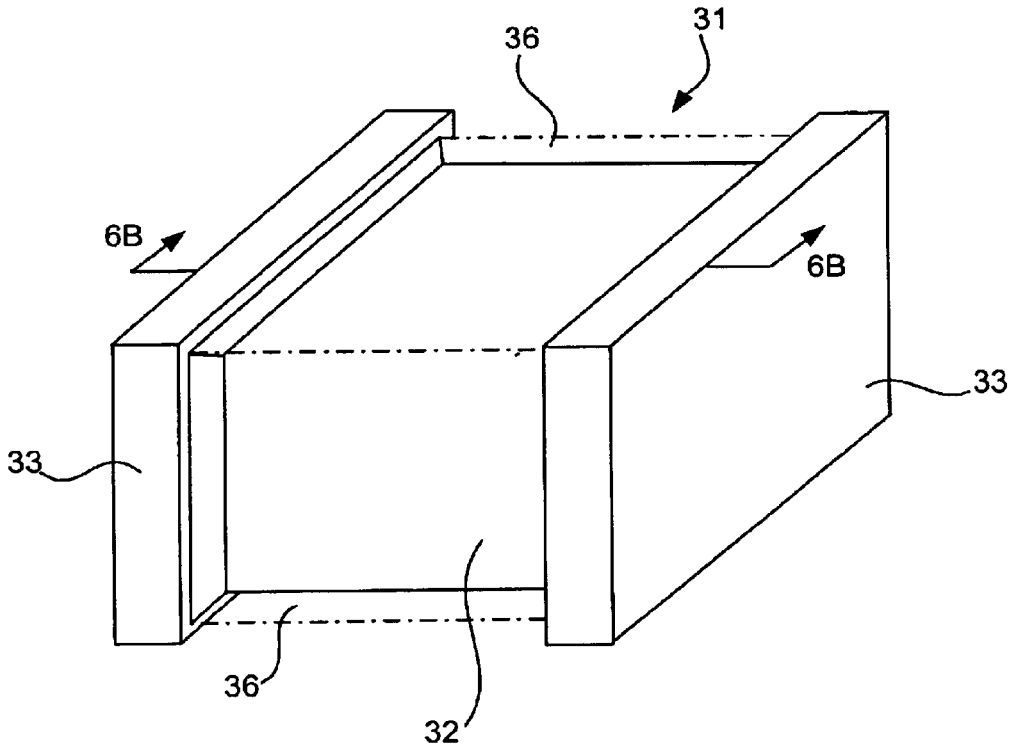
FIGS. 6A and 6B, together referred to as FIG. 6, show a thermistor chip according to still another embodiment of this invention, FIG. 6A showing its external view and FIG. 6B being a sectional view taken along line 6B—6B of FIG. 6A.
Figure 6B:
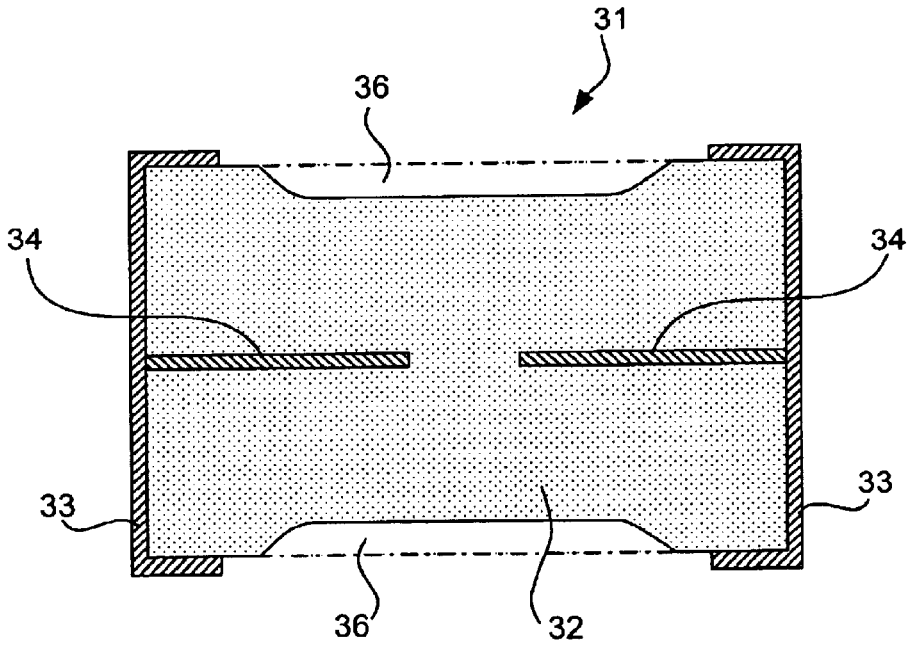

FIGS. 6A and 6B show still another thermistor chip 31 embodying this invention, comprising a thermistor body 32, outer electrodes 33 and inner electrodes 34, the thermistor body 32 having melted portions 36 formed thereon. The thermistor body 32 comprises a semiconducting ceramic material having oxides of a plurality of transition metals such as Mn, Ni, Co, Fe, Cu and Al. The melted portions 36 are formed on externally exposed surface portions of the thermistor body 32 not covered by the outer electrodes 33, melted away by a solvent (as explained above with reference to FIG. 3A). The inner electrodes 34 are formed as a mutually oppositely disposed pair inside the thermistor body 32, each in an electrically connected relationship with a corresponding one of the outer electrodes 33.

To produce a thermistor chip as shown at 31 in FIG. 6, a thermistor body 32 is prepared first and outer electrodes 33 are formed on its mutually opposite end parts. Next, it is dipped in a solvent 10 as described above to partially melt away externally exposed surfaces of the thermistor body 32 to thereby form the melted portions 36. This method is characterized wherein the thermistor body 32 is dipped in the solvent 10 without first forming any resist layer thereon. For this reason, the solvent 10 must be of a kind such as a plating liquid which melts the thermistor body 32 but not the outer electrodes 33.

In all of the examples described above, the step of dipping a plurality of thermistor chips in a solvent to form a melted portion on each is carried out by initially measuring the resistance value between the pair of outer electrodes of each and ranking them and dividing into different groups according to their measured resistance values. Thermistor chips belonging to the same group are dipped together in a solvent so as to finally obtain thermistor chips of more or less the same resistance value. This method according to this invention will be explained next more in detail with reference to the type of thermistor chips shown in FIG. 6.

Figure 7:
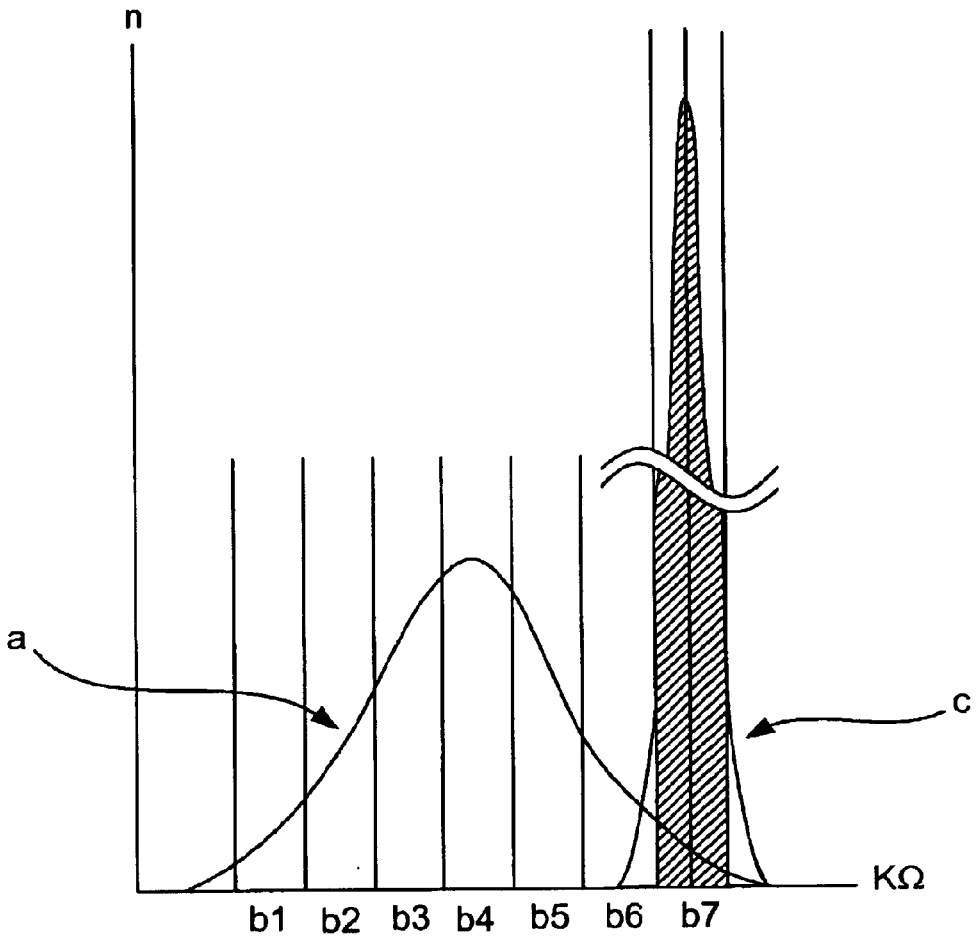
FIG. 7 is a graph showing the distribution of resistance values of thermistor chips before and after they go through a melting process embodying this invention.
Figure 8A:
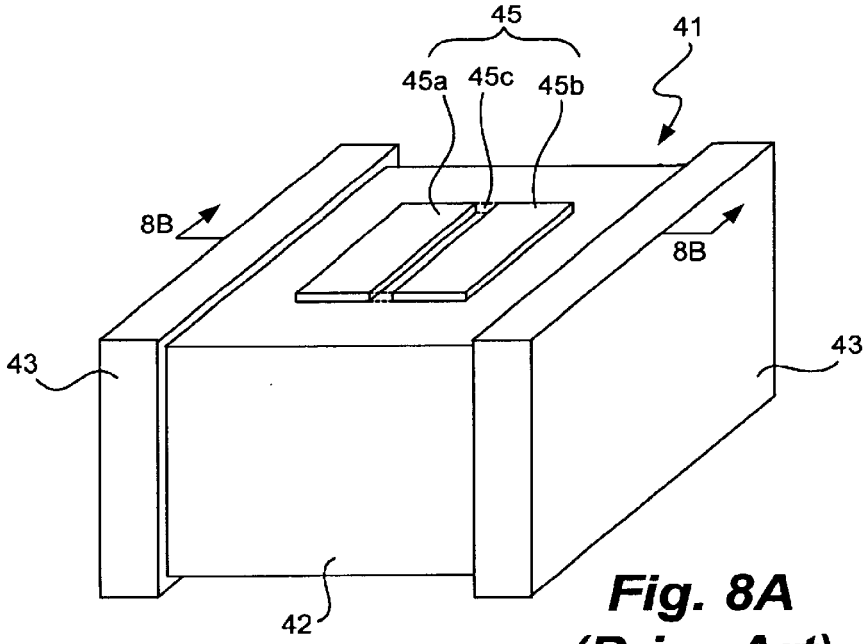
Fig. 8A (Prior Art)
FIGS. 8A and 8B, together referred to as FIG. 8, show a prior art thermistor chip, FIG. 8A showing its external view and FIG. 8B being a sectional view taken along line 8B—8B of FIG. 8A.
Figure 8B:
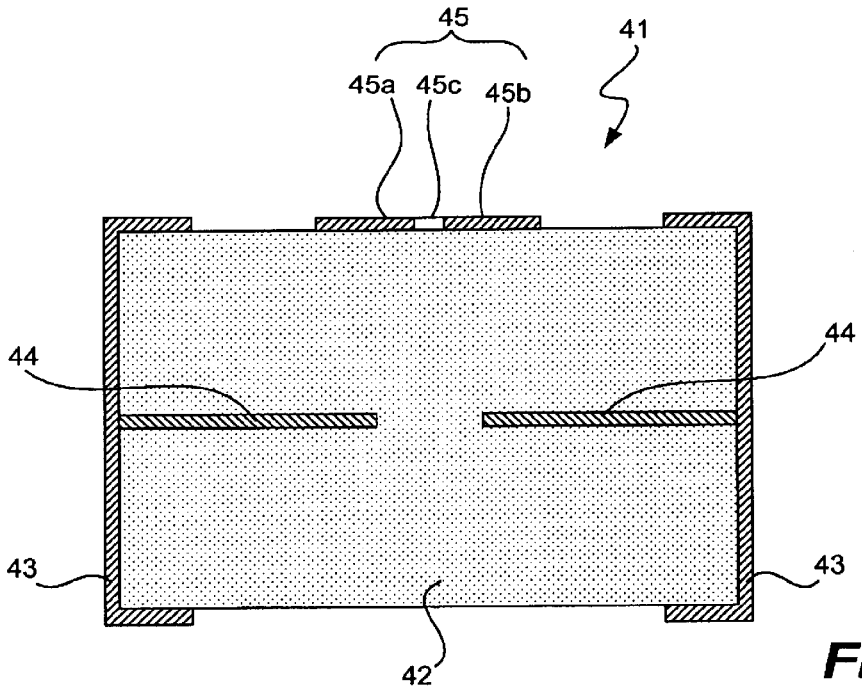
Fig. 8B (Prior Art)

First, let us assume that there are many thermistor chips as shown in FIG. 2A which are yet to be dipped in the solvent 10, and the distribution of their resistance values (between their outer electrodes 3) is obtained, say, as shown by Curve "a" in FIG. 7, the vertical axis therein showing the number n of thermistor chips with resistance values within each of the ranges (ranks) in the resistor value. As shown in FIG. 7, the range corresponding to those of the thermistor chips having lowest resistance values is herein referred to as Rank "b1", the ranges corresponding to higher resistance values being correspondingly and sequentially referred to as Ranks "b2", "b3", etc. The range corresponding to the thermistor chips having highest resistance values is Rank "b7". In other words, the thermistor chips prior to the melting process are divided into seven ranks according to their resistance values, and they are subjected to a melting process according to their ranks to have the externally exposed surfaces melted by the solvent 10, that is, the thermistor chips belonging to different ranks are subjected to different melting process.

The resistance value of each thermistor chip 1*a* prior to the melting process is determined by many factors such as the specific resistivity, size and shape of the thermistor body 2*a,* the size and shape of the outer electrodes 3 and their combinations. When a thermistor chip 1*a* is dipped in the solvent 10, its thermistor body 2*a* has externally exposed portions melted away and becomes smaller as a whole, causing the resistance value to increase. Thus, those of the thermistor chips 2*a* with relatively lower resistance values, belonging to lower ranks such as Ranks b1 and b2 are dipped in the solvent 10 for a longer time such that larger portions of their thermistor bodies will be melted away so as to obtain a specified target resistance value intended for these thermistor chips. Similarly, the time for dipping is made shorter for those thermistor chips having relatively higher resistance values and belonging to higher ranks such as Ranks 5 and 6 such that only small portions of their thermistor bodies will be melted away and the increase in their resistance values will be accordingly smaller. Those thermistor chips in Rank b7 are not required to be dipped in the solvent 10 because their resistance values are already close enough to the target resistance value. Curve "c" in FIG. 7 shows the distribution of the resistance values of the thermistor elements 31 after such individual dipping processes, having a distribution around the target resistance value (within the range of Rank b7) which is much narrower than that of Curve "a" before the dipping process.

The invention is described next by way of an actual test experiment which was carried out to produce thermistor chips 31 shown in FIG. 6, the target resistance value being 10.0KΩ±0.1KΩ. For this experiment, thermistor chips 1*a* mostly with lower resistance values in the range from 8.7KΩ to 10.1KΩ were prepared and the ranges for ranks b1–b7 were all set equal to 0.2KΩ. These thermistor chips 1*a* were dipped in a solvent comprising a plating liquid, with the time of dipping differentiated according to the rank, and their resistance values were measured after the dipping. The results are summarized in Table 1 below.

TABLE 1

| | Before Dipping | | After Dipping | |
|---|---|---|---|---|
| Rank | Resistance Range (KΩ) | Average Resistance (KΩ) | Time of Dipping (min) | Average Resistance (KΩ) |
| b1 | 8.70–8.90 | 8.86 | 90 | 9.95 |
| b2 | 8.90–9.10 | 9.01 | 75 | 9.97 |
| b3 | 9.10–9.30 | 9.23 | 60 | 10.02 |
| b4 | 9.30–9.50 | 9.40 | 45 | 9.96 |
| b5 | 9.50–9.70 | 9.59 | 30 | 9.95 |
| b6 | 9.70–9.90 | 0.77 | 15 | 10.01 |
| b7 | 9.90–10.10 | 9.95 | 0 | 9.95 |

Table 1 shows that although the variation in the average resistance values was large among the thermistor chips 31 before the dipping, the average resistance value of the thermistor chips of each rank ended up within the target range.

Although the invention was described above by way of only one test experiment, this is not intended to limit the scope of the invention. If the thermistor chips are divided into a larger number of ranks and the time for dipping is varied accordingly, the variation in the resistance values can be reduced further. According to another embodiment of invention, thermistor chips in different ranks may be dipped in solvents with different concentrations while the time for the dipping is kept approximately the same. According to still another embodiment of this invention, the extent to which the resist layers cover the surface of the thermistor chip is varied according to the rank such that the variation in the resistance values among different ranks can be reduced although the concentration of the solvent and the time of dipping are kept constant.

It now goes without saying that many modifications and variations are possible within the scope of this invention. The number and shape of inner electrodes are not intended to limit the scope of this invention, and inner electrodes need not be electrically connected to the outer electrodes. The presence itself of inner electrodes is not required according to this invention. It is further to be reminded that the present invention is not limited to the production of thermistor chips with a negative temperature coefficient but is also applicable to the production of thermistor chips with a positive temperature coefficient, for example, with $TiO_3$ as main constituent.

What is claimed is:

1. A method of producing thermistor chips, said method comprising the steps of:

preparing thermistor bodies each having outer electrodes on end parts thereof;

dipping said thermistor bodies each having outer electrodes thereon in a solvent to thereby melt away exposed surface portion thereof; and dividing said thermistor bodies with outer electrodes into different ranks according to resistance value between said outer electrodes, the step of dipping being carried out such that different amounts are melted away from said thermistor bodies belonging to different ranks.

2. The method of claim 1 further comprising the steps of:

forming resist layers so as to cover said outer electrodes but to leave said exposed surface portion of said thermistor body; and removing said resist layers after the step of dipping.

3. The method of claim 2 wherein the step of dipping is carried out for different time lengths for different ranks.

4. The method of claim 2 wherein the step of dipping is carried out by using solvents with different concentrations for different ranks.

5. The method of claim 1 wherein the step of dipping is carried out for different time lengths for different ranks.

6. The method of claim 1 wherein the step of dipping is carried out by using solvents with different concentrations for different ranks.

* * * * *